US005153483A

United States Patent [19]

Kishino et al.

[11] Patent Number: 5,153,483

[45] Date of Patent: Oct. 6, 1992

[54] DISPLAY DEVICE

[75] Inventors: Takao Kishino; Yoichi Kobri, both of Mobara, Japan

[73] Assignee: Futaba Denshi Kogyo Kabushiki Kaisha, Mobara, Japan

[21] Appl. No.: 683,293

[22] Filed: Apr. 10, 1991

[30] Foreign Application Priority Data

Apr. 12, 1990 [JP] Japan ..... 2-095119

[51] Int. Cl.[5] ..... H01J 23/16

[52] U.S. Cl. ..... 315/3; 315/169.1; 315/349

[58] Field of Search ..... 315/169.1, 169.3, 349, 315/3; 313/308, 309, 351

[56] References Cited

U.S. PATENT DOCUMENTS 3,855,499 12/1974 Yamada et al. ..... 315/169 R
4,006,383 2/1977 Luo et al. ..... 315/169.3
4,020,381 4/1977 Oess et al. ..... 313/351 X
4,528,480 7/1985 Unagami et al. ..... 315/169.1
4,575,765 3/1986 Hirt ..... 315/169.3 X
4,704,559 11/1987 Suginoya et al. ..... 315/169.1
4,908,539 3/1990 Meyer ..... 315/169.3
5,015,912 5/1991 Spindt et al. ..... 315/169.3 X

*Primary Examiner*—Eugene R. LaRoche
*Assistant Examiner*—Son Dinh
*Attorney, Agent, or Firm*—Oblon, Spivak, McClelland, Maier & Neustadt

[57] ABSTRACT

A display device capable of exhibiting sufficient luminescence using FECs as a plane electron source. The display device includes a substrate section or a cathode substrate and a display substrate section or an anode substrate. The substrate section includes TFT sections and FEC sections each connected to one electrode of each of the TFT sections. The display substrate section includes three anodes arranged in a manner to be divided from each other. On each of the anodes is deposited a phosphor layer. Both substrate sections are arranged opposite to each other through a vacuum atmosphere.

5 Claims, 5 Drawing Sheets

DISPLAY DEVICE

BACKGROUND OF THE INVENTION

This invention relates to a plane type display device used as an image display device for various kinds of electronic and electric appliances, a TV or the like, and more particularly to a display device which uses field emission cathodes (hereinafter referred to as "FECs") acting as an electron generating source in combination with thin film transistors (hereinafter referred to as "TFTs") to provide a display of high luminescence.

A plane-type display device which has been conventionally put into practice includes a liquid crystal display device (LCD), an electroluminescence display device (ELD), a plasma display panel (PDP), a fluorescent display device (VFD) and the like. Various improvements have been made on the plane-type display device in order to provide a substitute for a cathode ray tube.

For example, for the purpose of improving the number of picture cells and display density in the LCD, techniques have been employed wherein one electrode means is constituted by a TFT array and the selection of picture cells is carried out through the driving of a matrix while using one of the electrodes of the TFTs as one electrode. Such TFT techniques are likewise employed in the VFD, wherein each of electrodes of the the TFTs constitutes one electrode of the VFD and a phosphor is deposited on the electrode to form an anode, which is subject to an On/Off operation by matrix driving using the TFTs, to thereby control impingement of electrons from a cathode onto the anode, resulting in light emission or luminance of the anode.

The recent progress of techniques for finely processing a semiconductor has caused a possibility of permitting the FEC which was developed to provide a cathode for a vacuum tube IC to to be used as a plane electron source, so that the application to various devices are being considered now.

A typical structure of the FEC is exemplified in FIG. 6, wherein reference numeral 100 designates a substrate doped with impurities in high concentration, resulting in the substrate being provided with high conductivity. The substrate 100 is formed thereon with an insulating layer 101 made of $SiO_2$, which is formed therein with cavities 102. In each of the cavities 102 is arranged an emitter 103 formed of Mo so as to act as an electron emitting section. Also, the FEC includes a thin film which is made of Mo and deposited on the insulating layer in a manner to surround the emitter 103, to thereby function as a gate electrode 104.

The FEC constructed as described above may be produced by resist coating utilized as fine processing techniques in the manufacture of a semiconductor, electron beam exposure, etching or the like. The FEC is so formed into such dimensions that the cavity 102 is 1 to 2 $\mu$m in diameter, the insulating layer 101 is 1 to 2 $\mu$m in thickness and the gate electrode 104 is about 0.4 $\mu$m in thickness. Also, the emitters of 100 to 10,000 in number. each of which is formed into a cone-like shape, are integrated on an area of about 25 mm square, leading to the FEC.

The so-constructed FEC causes an electric field of about $10^6$ to $10^7$ V/cm to be generated between the distal end of the emitter 103 and the gate electrode 104 when the gate electrode is biased within the range between tens of volts and hundreds of volts against the substrate 100, so that electrons of hundreds mA in all may be discharged from the distal end of the emitter 103.

Thus, the FEC is expected to be reduced in power consumption because of a cold cathode as compared with a thermionic cathode which has been conventionally used for a fluorescent display device, permit matrix driving of the cathode itself acting as an electron emitting source and provide a plane electrode of a large area. A display device using the FECs has been proposed as disclosed in Japanese Patent Application Laid-Open Publication No. 221783/1986 and "JAPAN DISPLAY '86" pp. 512 to 514.

However, the LCD using the TFTs further requires driving TFTs arranged on the same plane as picture cells in addition to TFTs for the picture cells, as well as a capacitor for approaching the duty to 1. Unfortunately, they cause a dead area to be formed in a display area, resulting in failing to improve display density.

Also, the display device using the FECs generally employs a driving mode wherein an X-Y matrix is defined by the substrate on which the FECs of a cone-like shape are arranged (cathode line) and a gate electrode line and the FECs are driven in a time-sharing manner. Thus, the duty cycle is decreased as the display density is increased, so that the display device fails to exhibit sufficient luminescence. An increase in luminescence requires an increase in gate voltage or an anode voltage, thus, the structure of the device is complicated because steps such as insulation between the electrodes and the like are required.

SUMMARY OF THE INVENTION

The present invention has been made in view of the foregoing disadvantages of the prior art.

Accordingly, it is an object of the present invention to provide a display device which is capable of exhibiting sufficient luminescence using FECs as a plane electron source.

In accordance with the present invention, a display device is provided. The display device includes a substrate section which is a cathode substrate and a display substrate section which is an anode substrate. The substrate section includes thin film transistor sections (TFT sections) which exhibit a memory function and field emission cathode sections (FEC sections) each connected to one electrode of each of the TFT sections. The display substrate section includes one anode or a plurality of anodes arranged in a manner to be divided or separated from each other. On the anode or each of the anodes is deposited a phosphor layer. The substrate section and display substrate section are arranged opposite to each other through a vacuum atmosphere.

In the display device of the present invention constructed as described above, the TFT array formed on the substrate section is driven in a matrix manner and the FEC array connected to the TFT array is selected in a time-sharing manner, for example, at every column of the array driven. Concurrently, in synchronism with the operation, a display signal is supplied to each row of the array arrangement to select the FEC sections to discharge an electrical field, to thereby emit electrons. The TFTs each include a capacitance, which holds an input signal therein until the next signal is supplied thereto, thus, the electrons continue to be discharged during this interval of time.

To the phosphor layer deposited on the anode or each of the anodes arranged on the display substrate is applied an anode voltage. Thus, electrons emitted from FEC sections impinge on the phosphor layer, resulting in light-emission or luminance. The luminance continues until the next signal is supplied to the signal line of the TFT sections. This causes the duty cycle for luminance to be substantially 1, so that high luminescence may be exhibited. Alternatively, this permits the display device to be driven at a significantly reduced voltage.

Further, the above-described construction of the present invention eliminates a necessity of providing a control circuit section for selecting picture cells, to thereby improve display density and ensure continuity of a display.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENT

Now, a display device according to the present invention will be described hereinafter with reference to the accompanying drawings.

Figure 1:
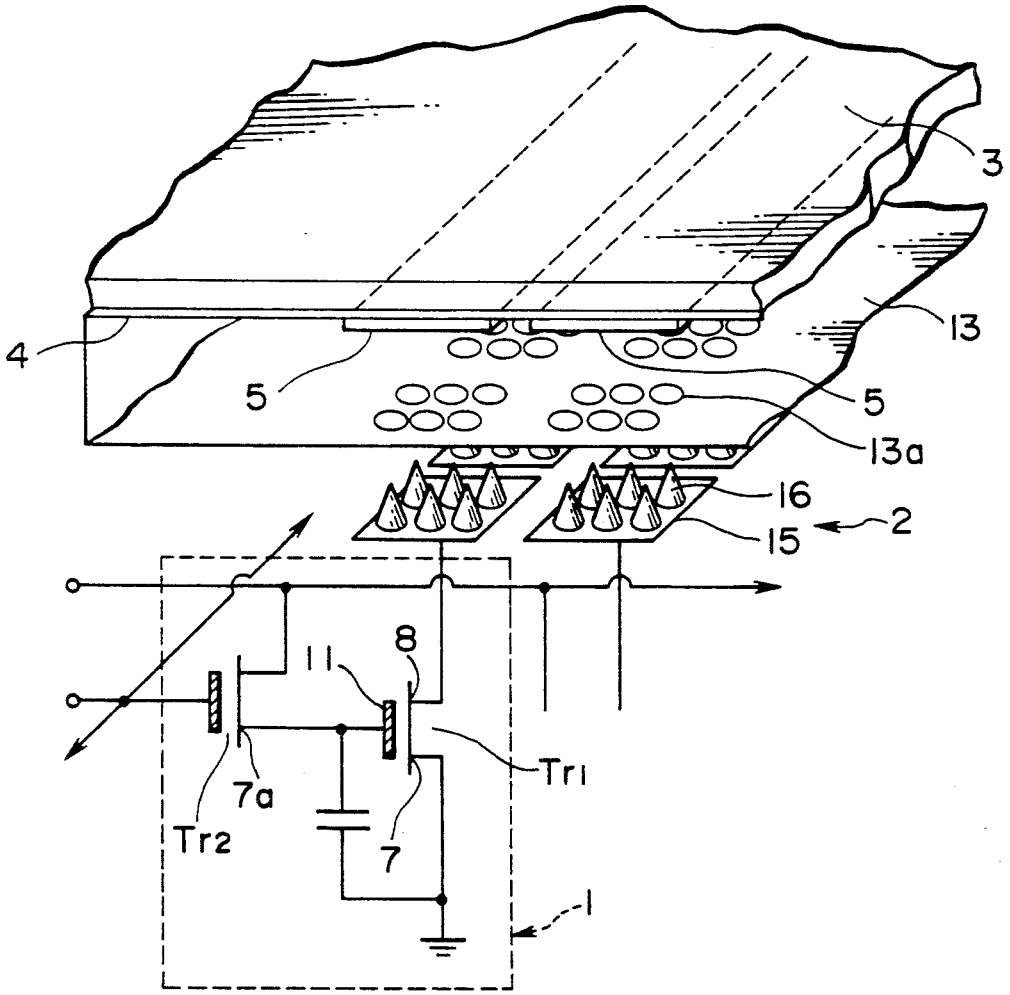
FIG. 1 is a schematic view showing an electrode structure for an embodiment of a display device according to the present invention.
Figure 2:
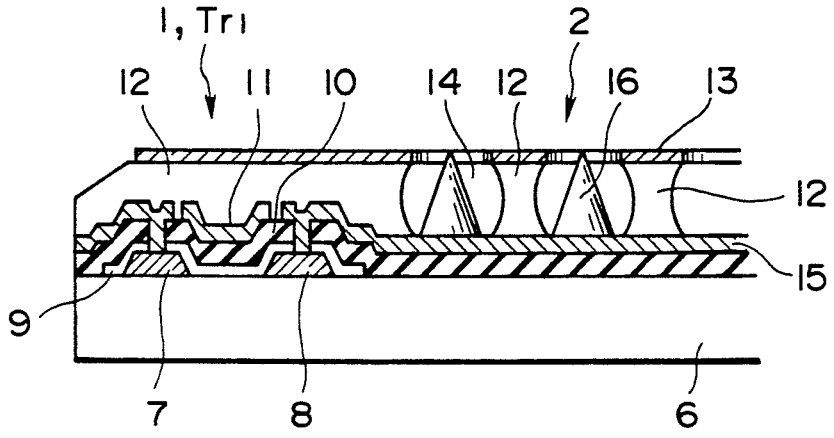
FIG. 2 is a sectional view showing a cathode substrate.
Figure 6:
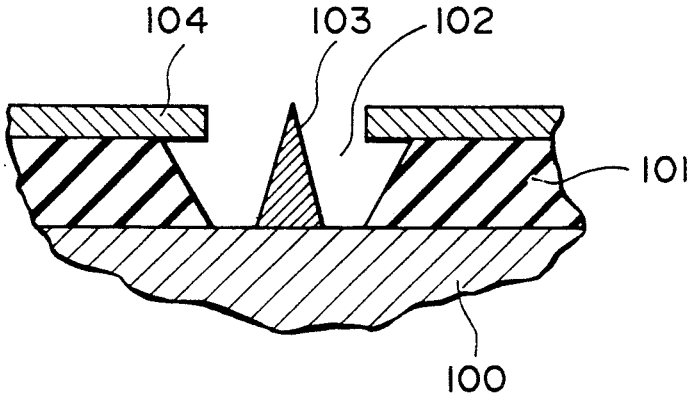
FIG. 6 is a sectional view showing the structure of a field emission cathode.

FIG. 1 schematically shows an electrode structure for an embodiment of a display device according to the present invention and FIG. 2 shows a cathode substrate serving as a substrate section. Reference numeral 1 designates thin film transistor sections (hereinafter referred to as "TFT sections"), which include two transistors Tr1 and Tr2 and a capacitor C for every picture cell. Reference numeral 2 is a field emission cathode sections (hereinafter referred to as "FEC sections"). In each of the FEC sections, FECs as many as 100 to 1,000 in number each having such a micro structure as shown in FIG. 6 are integrated on a common cathode, resulting in forming one picture cell. Emitters of the FECs for one picture cell are connected to one of electrodes of the drive transistor Tr1 (drain electrode or source electrode) of the TFT section 2. Also, a gate electrode having a holes corresponding to each of the emitters is arranged in proximity to the emitters. The gate electrode is common to all the picture cells.

The display device of the illustrated embodiment also includes an anode substrate 3 serving as a display substrate section. The embodiment is so constructed that a display is observed through the anode substrate 3, therefore, it is formed of a transparent material such as glass, ceramics or the like. On the surface of the anode substrate 3 opposite to the FEC sections 2 is arranged at least one anode 4, on which a phosphor layer 5 is deposited.

Figure 3:
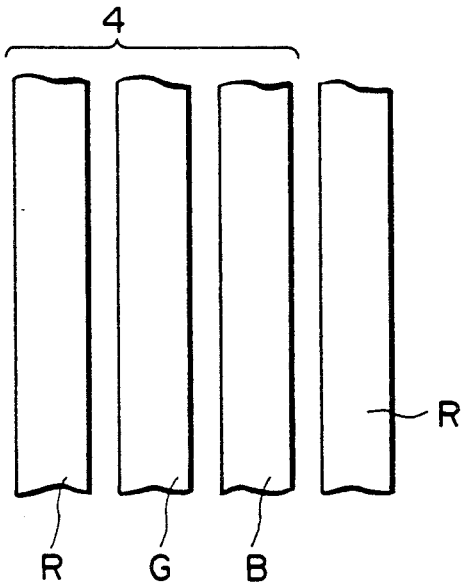
FIG. 3 is a schematic view showing an anode structure for a full color display.

When a monochromatic display is desired, one anode may be commonly used for all the picture cells and one phosphor layer 5 may be deposited all over the anode 4. However, for the purpose of preventing cross talk of the display, a plurality of the phosphor layers 5 may be deposited in a stripe-like manner on the anode 4. Alternatively, they may be deposited in a dot-like manner. When a full-color display is desired, three such anodes 4 are arranged in a divided manner, on each of which phosphor layers of red, green and blue luminous colors (R), (G) and (B) are deposited respectively, as shown in FIG. 3.

The display device of the illustrated embodiment further includes a cathode substrate 6, which is constructed as shown in FIG. 2. In FIG. 2, the driving transistor Tr1 of the TFT section 1 and the FEC section 2 are shown. The illustrated embodiment employs a polycrystalline Si thin film transistor structure. More particularly, on the cathode substrate 6 made of an insulating material such as glass or the like are arranged a source electrode 7 and a drain electrode 8, on which a semiconductor layer 9 made of polycrystalline silicon is deposited in a manner to bridge both electrodes. The structure also includes a gate 11 formed by laminating a gate insulating film 10 made of $SiO_2$ on the semiconductor layer 9, thus, the transistor Tr1 is formed. The gate insulating film 10 and drain electrode 8 each include a lead (not shown) deposited on the cathode substrate 6 so as to extend to the FEC section 2. The source electrode 7 includes a lead (not shown) electrically connected thereto, which is then grounded. The leads of the source electrode 7 and gate 11 are superposed on each other through an insulating layer, at which the capacitor C is formed. The lead of the gate 11 is connected through a lead wire to a source electrode 7*a* of the switching transistor Tr2 (FIG. 1).

The TFT section 1 and capacitor C may be produced by vapor deposition, sputtering and etching conventionally used for the manufacturing of a semiconductor. On the so-formed TFT section 1 is formed an insulating layer 12 made of a suitable material such as $Si_3N_4$, $SiO_2$ or the like so as to act as a passivation layer. The insulating layer 12 is deposited in a manner to extend to the FEC section 2.

Formation of the FEC section 2 is carried out by first depositing, on the insulating layer 12 also serving as the passivation layer of the TFT section 1, a metal film such as, for example, a molybdenum (Mo) film which forms a gate electrode 13 of the FEC by electron beam deposition techniques. Then, the gate electrode 13 is formed with a plurality of holes 13*a* by photolithography. Subsequently, the insulating layer 12 is subject to etching to expose the lead of the drain electrode 8 while keeping the gate electrode 13 masked, to thereby form cavities 14. The exposed portions of the lead of the drain electrode 8 each constitute a cathode 15 of the FEC. Finally, Mo is deposited on the cathode 15 in the cavity 14 by electron beam deposition techniques, so that a plurality of cone-like emitters 16 are formed so as to serve as an emitter group, resulting in the FEC section 2 being constructed.

In the illustrated embodiment, the FEC section 2 for one picture cell connected to each driving transistor Tr1 includes the emitters 16 as many as 100 to 1000 in number.

The anode substrate 3 and cathode substrate 6 arranged as described above serve as a front cover and a rear plate of a box-like envelope, respectively, which is then evacuated to high vacuum, leading to the display device of the illustrated embodiment.

The illustrated embodiment may be so constructed that banks each are arranged between the cathodes 15 formed on the cathode substrate 6 in a manner to extend perpendicular to the phosphor layer 5. Such construction effectively prevents cross talk of a display in the lengthwise direction of the phosphor layer. The banks may be arranged on the gate electrode 13 or anode substrate 3.

Figure 4:
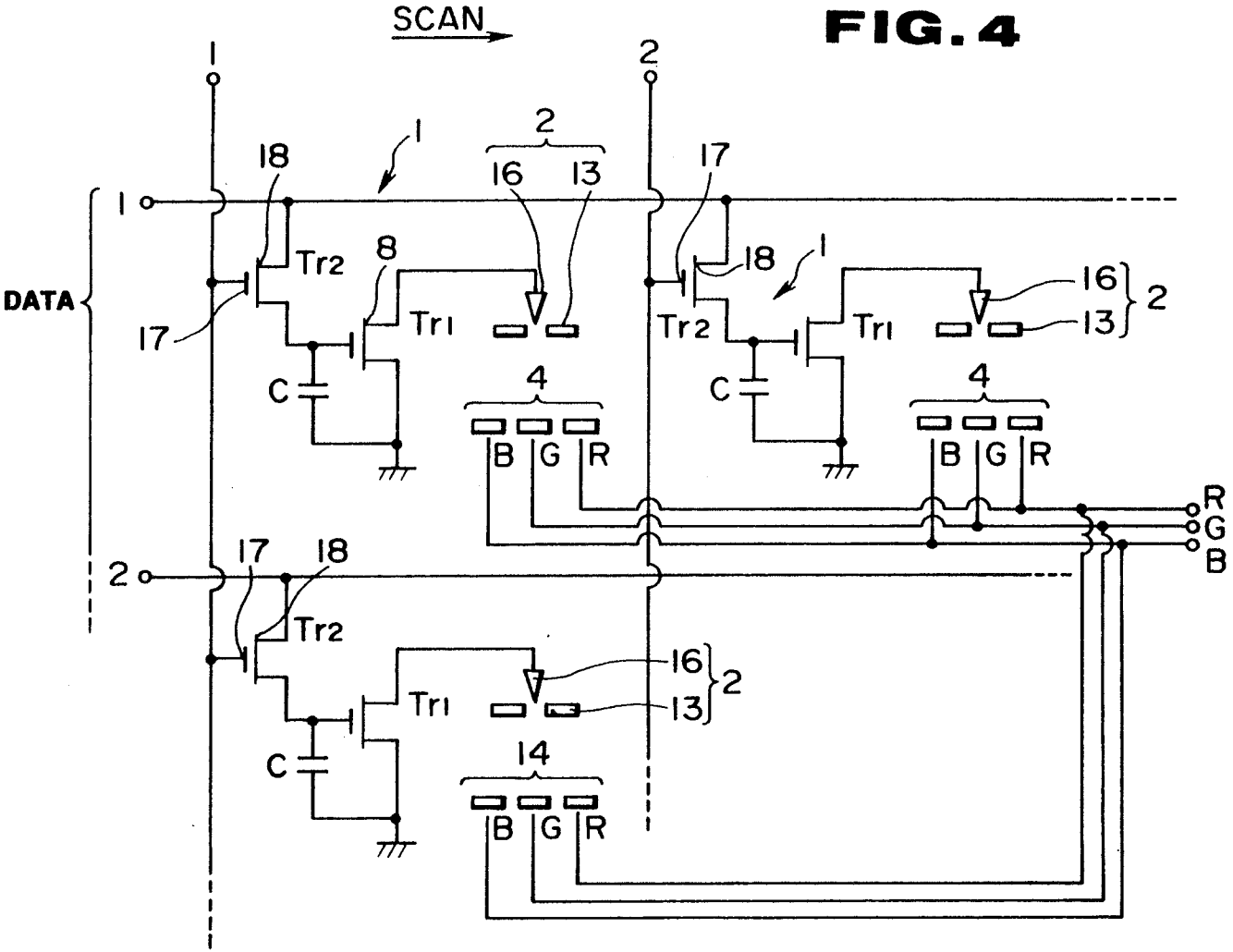
FIG. 4 is a circuit diagram view showing the principle of operation of the display device shown in FIG. 1 and the manner of connection between electrodes.

Now, the operation of the display device of the illustrated embodiment constructed as described above will be described hereinafter with reference to FIG. 4 showing the principle of operation of the display device. In the illustrated embodiment, three anodes 4 are arranged in a manner to be separated or divided from each other, on each of which phosphor layers of a red luminous color (R), a green luminous color (G) and a blue luminous color (B) are repeatedly deposited for a full-color display.

One picture cell consisting of R, G and B comprises the TFT section 1 including the transistors Tr1 and Tr2 and capacitor C, the FEC section 2 (the emitters 16 and gate electrode 13) connected to the drain electrode 8 of the transistor Tr1, and the three anodes 4 electrically divided from each other and each having the phosphor layers R, G and B deposited thereon. A plurality of the picture cells each constructed as described above are arranged in a matrix-like manner, to thereby provide a display picture plane.

The anodes 4 for the respective picture cells constituting the matrix-like display picture plane are commonly connected to each of phosphors R, G and B and then led out to external terminals, as shown in FIG. 4. Also, the gates 17 of the transistors Tr2 for the picture cells constituting the matrix are commonly connected at every column of the matrix and then led out to external terminals. Further, the drain electrodes 18 of the transistors Tr2 are commonly connected at every row of the matrix and then led out to external terminals.

Figure 5:
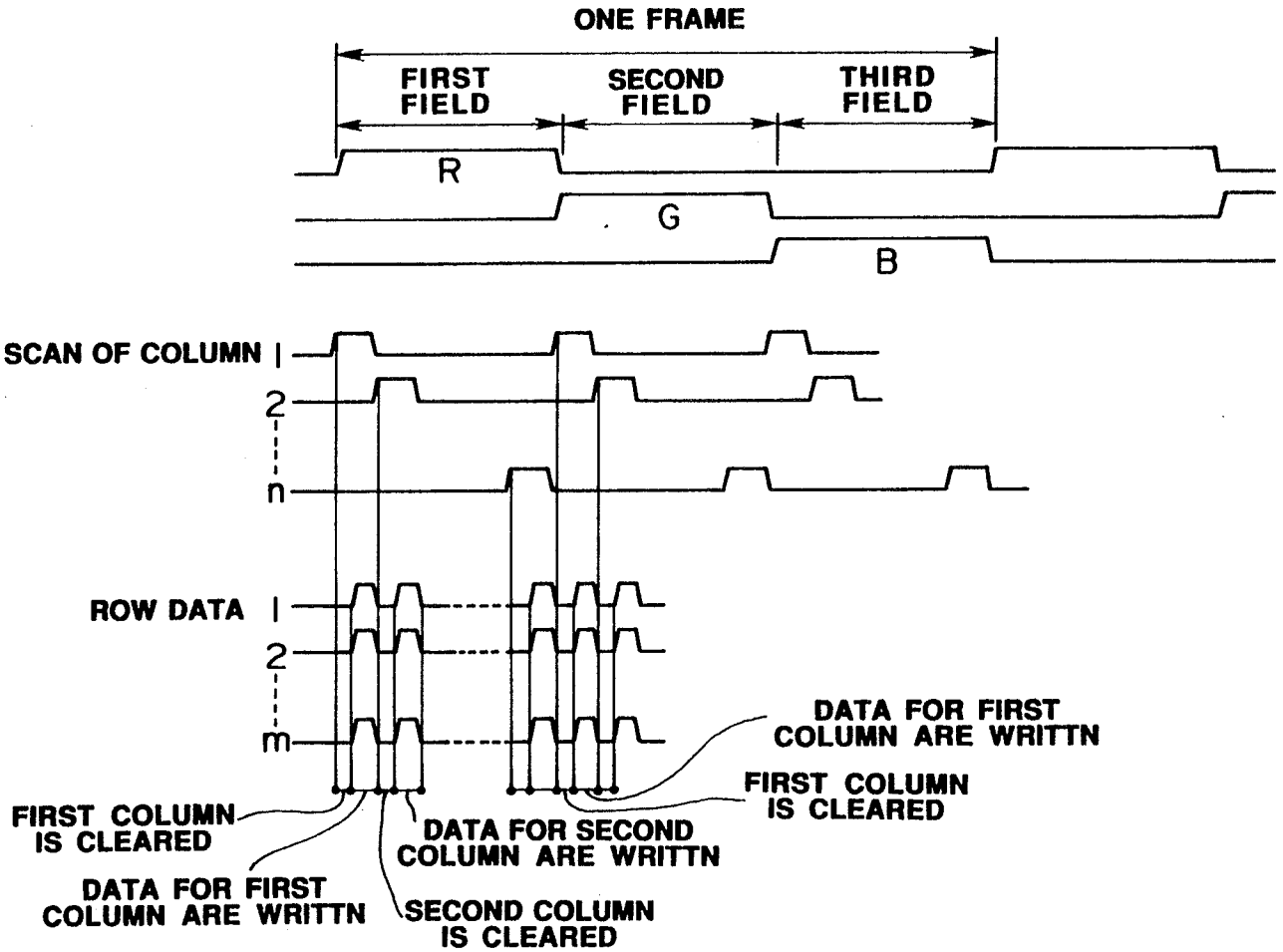
FIG. 5 is a drive timing chart showing the operation of the display device shown in FIG. 1.

Now, the manner of actually practicing the display device of the illustrated embodiment will be described with reference to FIGS. 4 and 5. The illustrated embodiment is constructed so as to carry out a full-color display as described above. More particularly, as shown in FIG. 5, it employs a system wherein data for red, green and blue luminous colors are indicated in first, second and third fields, respectively, for one picture cell (one frame).

In the first field, an anode voltage is applied to the red luminous color phosphor or section R of the anode 4 to apply a scan signal to the first column. This results in an ON signal being supplied to the gates of all the transistors Tr1 connected to the first column. Concurrently, a clear signal (earth potential or negative potential) is supplied to all row data lines (row data 1, 2, —, m in FIG. 5), to thereby cause the capacitors C of the TFT sections 1 connected to the first column to be discharged. Thus, the scan of the first column in FIG. 5 causes the first column to be cleared. Then, a row data signal is supplied to each of required rows depending upon row display data. More specifically, when light emission or luminance is desired, a signal "1" is supplied to required rows during a period of time for which data for the first column are written; whereas, when light emission is not desired, a signal "0" indicated at broken lines is supplied thereto.

The data signal is accumulated in the capacitor C through the transistor Tr2 kept turned on, so that the driving transistor Tr1 may be controlled. When the row data signal is "1", charges in the capacitor C cause the driving transistor Tr1 to be turned on, resulting in the emitter 16 having an earth potential, so that a high electrical field may be formed between the gate electrode 13 and the emitter 16 to cause electrons to be discharged from the emitter 16. The electrons then impinge on the anode 4 to which an anode voltage is applied, so that it carries out luminance of a red color. When the row data signal is "0", the electron discharge does not occur because no charge is accumulated on the capacitor C; thus, the anode 4 does not carry out light emission.

The capacitor C is kept charged even when the row data signal is extinguished and the transistor Tr2 is turned off. This results in the driving transistor Tr1 being kept turned on until the next clear signal is supplied thereto, so that the emitter 16 connected to the transistor Tr1 continues to emit electrons, to thereby cause the luminance of the anode 4 to be continued.

Similarly, the application of a column scan signal to the second column causes it to be selected, and row data are supplied thereto in synchronism with the column scan signal, resulting in light emission or luminance therefrom being controlled. When the display of a red luminous color in the first field is completed, the operation in the second field is initiated, wherein the capacitor of each of the columns is discharged or cleared at the preceding portion of the row data and then a display of a green luminous color is carried out in the second field. A similar operation is carried out in the third field, leading to a display of a blue luminous color.

The luminances of the three luminous colors in the three fields are mixedly recognized through an observer, resulting in a full-color image display being accomplished.

As can be seen from the foregoing, the display device of the present invention is so constructed that the FECs are driven through the TFT circuit exhibiting a memory function. Such construction permits the duty cycle to be increased to a level as high as "1". When a full-color display is carried out, it allows the duty cycle to be increased to a level as high as "⅓". Thus, the present invention permits the same luminescence as that obtained by the conventional display device using FECs as the electron source to be exhibited while decreasing the anode voltage.

Also, in the present invention, the electron discharge section and memory section are arranged on the side of the substrate, thus, the anode forming the display plane can be closely arranged.

We claim:

1. A display device comprising:

a box-like envelope comprising an anode substrate as a front cover and a cathode substrate as a rear plate in a vacuum atmosphere;

thin film transistor sections formed on said cathode substrate comprising two transistors and a capacitor for each of a plurality of picture cells, said thin film transistor sections exhibiting a memory function;

field emission cathode sections formed on said thin film transistor sections comprising a plurality of electrically separated cathode electrodes for each picture cell, each of said cathode electrodes being provided with a plurality of emitters and connected to one of said transistors to discharge an electrical field, to thereby emit electrons;

a gate electrode having holes corresponding to each of said emitters and arranged in proximity thereto; and a display substrate section formed on said anode substrate comprising at least one anode arranged opposite to said cathode substrate through a vacuum atmosphere and having a phosphor layer deposited thereon;

wherein said gate electrode is common to all of the picture cells.

2. A display device as defined in claim 1, wherein a plurality of phosphor layers are deposited in a stripe-like manner on said anode.

3. A display device as defined in claim 1, wherein a plurality of phosphor layers are deposited in a dot-like manner on said anode.

4. A display device as defined in claim 1, wherein said display substrate sections are divided into three sections on which phosphor layers of red, green and blue luminous colors are deposited, respectively.

5. A display device as defined in claim 1, wherein said cathode substrate comprises a source electrode and a drain electrode arranged thereon; a semiconductor layer made of polycrystalline silicon deposited thereon in a manner to bridge both electrodes; and a gate formed by laminating a gate insulating film made of $SiO_2$ on said semiconductor layer.

* * * * *